United States Patent [19]

Sassi

[11] Patent Number: 4,524,563

[45] Date of Patent: Jun. 25, 1985

[54] PROCESS AND PLANT FOR ASEPTIC FILLING OF PRE-STERILIZED, NON-RIGID CONTAINERS

[75] Inventor: Carlo Sassi, Parma, Italy

[73] Assignee: Tito Manzini & Figli S.p.A., Parma, Italy

[21] Appl. No.: 329,294

[22] Filed: Dec. 10, 1981

[51] Int. Cl.[3] ..... B65B 3/16; B65B 7/06; B65B 43/26; B65B 43/36

[52] U.S. Cl. ..... 53/426; 53/468; 53/469; 53/479; 53/268; 53/573; 53/373; 53/384; 141/10; 141/48; 141/91; 141/68

[58] Field of Search ..... 53/573, 373, 570, 268, 53/385, 459, 469, 384, 479, 512, 502, 468, 492; 141/48, 68, 91, 90, 92, 10, 67, 114, 313–317

[56] References Cited

U.S. PATENT DOCUMENTS

| | | | |
|---|---|---|---|
| 2,732,986 | 1/1956 | Whittington | 53/268 X |
| 2,855,006 | 10/1958 | Geisler | 141/48 X |
| 3,715,858 | 2/1973 | Durant et al. | 141/68 X |
| 3,775,945 | 12/1973 | Kuhnle | 53/385 |
| 3,850,207 | 11/1974 | Loliger et al. | 141/91 X |
| 4,024,896 | 5/1977 | Ishioka et al. | 141/91 X |
| 4,189,899 | 2/1980 | Merat et al. | 53/570 |
| 4,212,414 | 7/1980 | Beyens | 141/91 X |
| 4,311,173 | 1/1982 | Sailors, Jr. | 141/68 |
| 4,360,996 | 11/1982 | Rutter | 141/10 X |

*Primary Examiner*—Horace M. Culver
*Attorney, Agent, or Firm*—Brumbaugh, Graves, Donohue & Raymond

[57] ABSTRACT

The invention relates to a process and apparatus for aseptic filling of pre-sterilized non-rigid containers, especially foodstuffs containers. The said process involves taking laying hold of the container by means of air-suction, followed by sterilization of part of the container and the means holding same, then piercing of the actual container and subsequent introduction thereinto of sterile gas. This is followed by introduction of the foodstuff into the container and ultimate hermetical heat-sealing of the container thus filled. The apparatus used for carrying out the process comprises a movable workhead, positioned appropriately along a traverse overlying the conveyor bringing up containers for filling the workhead has means for taking hold of the container by suction, means for piercing the container, and for introducing sterile gas and foodstuff into the container. The workhead carries out such operations by moving into angularly distinct respective working postures. A series of movers in the apparatus provide for displacement of the workhead itself and of its individual parts. The apparatus also has feeder means for supply of foodstuff, sterile gas and sterilizer fluid, and means for controlling the start and finish of the individual stages, and regulating the operation thereof.

19 Claims, 10 Drawing Figures

PROCESS AND PLANT FOR ASEPTIC FILLING OF PRE-STERILIZED, NON-RIGID CONTAINERS

BACKGROUND OF THE INVENTION

The invention described herein is a process and related apparatus for filling pre-sterilized, non-rigid containers aseptically—and with a special eye toward foodstuffs.

Marked difficulties invariably attend containerfilling in aseptic conditions, inasmuch as it is hard to ensure and maintain sterilization both inside the containers themselves, and around the working parts which are in contact with and manipulating the containers. Furthermore, when particularly large containers are handled, operations are rendered more complex because of the need for creating a sterile zone of sufficient size—i.e. a very large zone— for the accommodation of large machinery for turning out the said large, filled containers.

Thus the need arises for containers which can be used with decidedly reduced costs. To this end, the use should be avoided—as far as possible—of containers with special filler apertures, as these add considerably to the cost of the single container.

The object of the invention described herein is that of eliminating the above-described drawbacks, by providing a process and related apparatus for carrying out aseptic filling of large containers—though not perforce in an aseptic environment—whilst allowing for the use of relatively low-cost containers.

A further object of the invention described herein is that of providing a process and related apparatus which will permit the use of containers whose overall dimension, when empty, may be drastically reduced.

A further object of the invention is that of providing a process and related apparatus which assure sterile filling of containers during the process itself, and of furnishing a simple and easily-operated filling apparatus.

SUMMARY OF THE INVENTION

These objects and others are all attained by the process described herein, which is characterized by the fact that it comprises the following stages:

- taking hold of the container by a workhead in such a way as to isolate a small portion of the said container's outer surface from the environment;
- sterilization of the said small portion of the container and of such parts of the workhead as make direct contact with the said small portion;
- piercing of the said small portion of the container's outer surface;
- introduction of sterile gas into the container by way of the puncture thus achieved;
- insertion into the container—through the self-same punctured hole—of a feeder tube for passage of the foodstuff to be packaged;
- introduction and simultaneous expulsion, respectively, of foodstuff through the said feeder tube into the container, and of sterile gas through the said hole from therein;
- interruption of the flow of foodstuff into the container, and subsequent withdrawal of the feeder tube therefrom;
- hermetical closure of the said container by means of heat-sealing;

- detachment of the said workhead from the container; and
- cleaning off of the workhead.

The invention also encompasses apparatus for carrying out the process including a workhead having a guider element which accommodates a coaxially disposed feeder tube which is capable of axial movement and possessing a foresection formed as a needle, a rear-section which connects with a first pipeline designed for injecting foodstuff into the said feeder tube interior, and an intervening shut-off valve. The guider element has a partially-enclosed annular chamber opening out at the lower extremity of the element itself and connected—by way of an appropriate aperture—with means for producing suction arranged for extraction of air from within the annular chamber. The guider element further includes a forward chamber, opening out at the lower extremity of said guider element and disposed coaxially thereto and located internally from the said annular chamber but not connected to it. The guider element also has a rear chamber—sealed from the exterior—which is disposed coaxially with said forward chamber and which is connected to it by way of a communicating hole through which the said feeder tube fore-section is caused to move back and forth. A seal is provided between the hole and the fore-section to ensure mutual isolation of said forward and rear chambers regardless of the position of said feeder tube fore-section. Each of said forward and rear chambers is furnished with an inlet aperture and an outlet aperture permitting entry to and exit from the chamber of sterile fluid and/or a sterilizer. Provision is also made for a first mover serving to produce said back and forth sliding motion between said guider element and said feeder tube. The apparatus further includes a first feeder means serving to despatch the foodstuff to be packaged into said first pipeline, a second feeder means designed for producing the flow of said sterile fluid and/or sterilizer to said forward and rear chambers, a regulator means serving to control the fluid entry to and exit from said forward chamber so as to maintain a predetermined pressure level therein, and a means for heat-sealing the container hermetically after it has been filled.

BRIEF DESCRIPTION OF THE DRAWINGS

Further features and advantages of the invention described herein will be apparent from the detailed description of a preferred, though not exclusive embodiment of the apparatus and process to which the invention refers, illustrated in a strictly representative example with the aid of the accompanying drawings, in which.

DESCRIPTION OF THE PREFERRED EMBODIMENT

Figure 1:
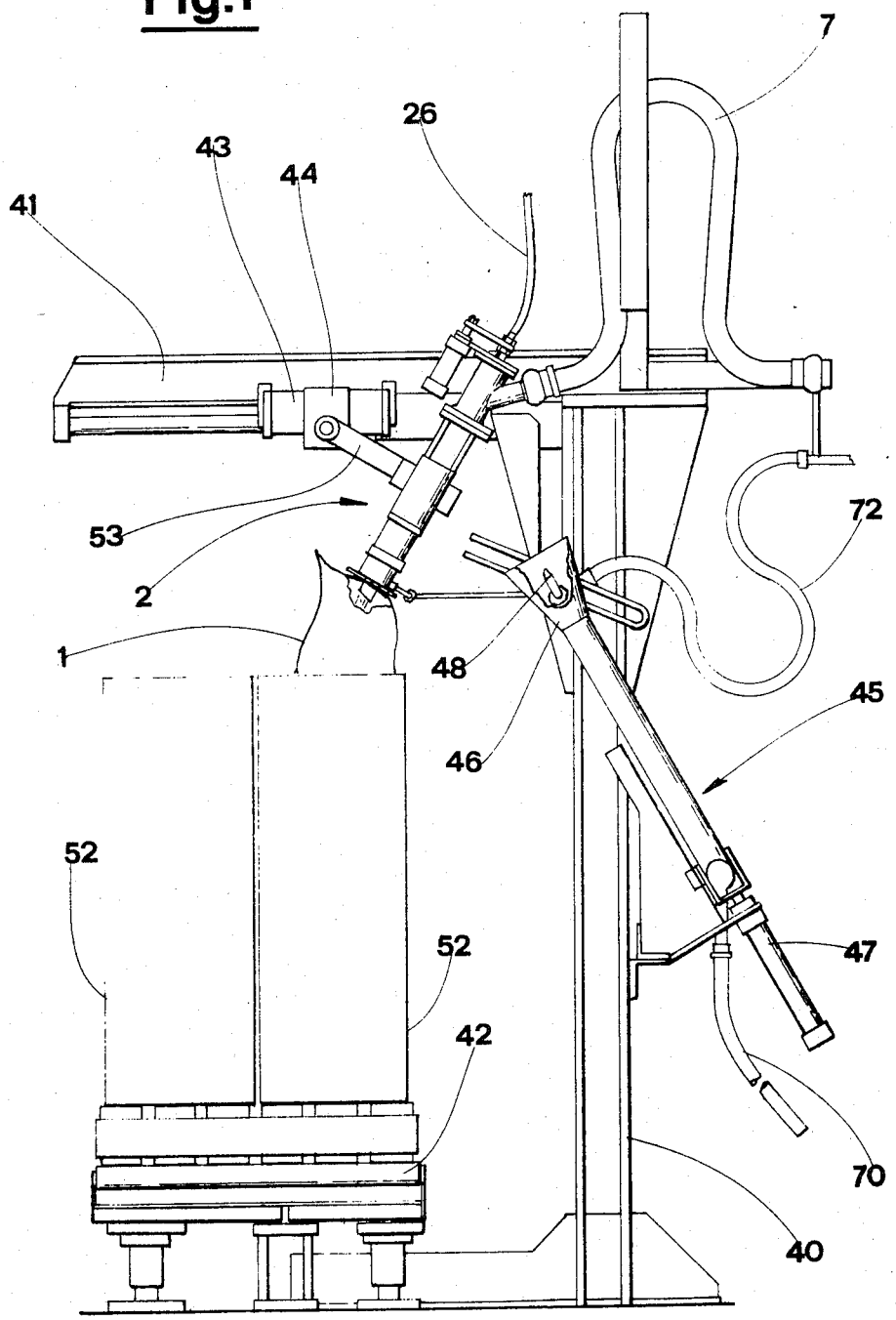
FIG. 1 shows a vertical elevation of the basic structure which carries the apparatus workhead.

The apparatus described herein comprises a basic upright structure 40 provided with a horizontal traverse 41, the latter being positioned above a conveyor 42 which may be moved forward as desired and carries containers 1 for filling. The container—being non-rigid—cannot remain erect of itself, and is therefore equipped with a rigid support receptacle 52, preferably made of cardboard.

A workhead 2 is attached to the traverse 41 and a third mover consisting of a jack represented schematically by 43, when operated, causes workhead 2 to slide back and forth along traverse 41—thus enabling the workhead to engage a number of single containers 52 disposed side-by-side across a particular section of the conveyor 42.

A fourth mover, denoted schematically by block 44, is attached to workhead 2 in such a way as to travel therewith along traverse 41. The fourth mover 44 serves to move the workhead 2 into any of several working postures, each said posture angularly distinct from the others, for reasons better described hereinafter. More exactly, the function of said fourth mover 44, which may be a conventional pneumatically operated unit, is that of rotating an output pivot thus causing the workhead to adopt one of three positions, i.e., a first working position A in which the head is inclined with axis approx. 60° to the vertical; a second working position B in which the head is inclined with axis approx. 30° to the vertical; and a third working position C in which the head is inclined approx. 30° to, though on the opposite side of the vertical, with respect to positions A and B; such rotation being achieved by the conversion of pressure supplied by the said pneumatic unit.

Mover 44 is fed with fluid pressurized at values between an upper and a lower limit; the limit positions—i.e. working postures A and C—are reached at the points wherein fluid pressure to the unit is at minimum and maximum, respectively. In order to gain the intermediate position B, fluid fed to the mover 44 should arrive at a well-defined, relative intermediate pressure. To this end provision is made for pressure regulators designed to impose accurate control on the fluid supply pressure.

Rotation imparted by the output pivot of the unit 44 is transmitted to workhead 2 by way of a rod-connection 53 connected at one end to the output pivot of the mover 44 and affixed at the other to workhead 2.

Said workhead 2 comprises a guider element 3, having a tubular conformation which accommodates a tubular feeder 4, disposed coaxially therein and capable of back-and-forth axial movement. The feeder tube 4 incorporates a fore-section formed as a syringe, or needle, 5 and a rear-section 6; the latter having a further tubular section or branch 29 protruding from the lateral surface thereof and having its axis inclined with respect to that of said feeder tube 4. The free extremity of branch 29 of feeder tube 4 is connected to a first pipeline 7 through which the product for packaging is injected into feeder tube 4. Said connection between branch 29 and first pipeline 7 is achieved by way of a union 30 incorporating an annular groove 31 located where the branch and pipeline conjoin. Sterile fluid is circulated under pressure within said groove 31 by way of entry 54 and exit 55 apertures and seal-rings 56 are disposed either side of said annular groove. In this way, the union prevents non-sterile, outer air from infiltrating between the mating surfaces of branch 29 and pipeline 7, and therefore avoids pollution of the foodstuff by impure air.

The fore-section 5 and rear-section 6 of the feeder tube 4 are connected by shut-off valve 8 having a valve seat 22 being located on the inner surface of the feeder tube between the fore- and rear-sections. The valve obturator 23 is located upon the outer surface of the lower end of a hollow stem 24 disposed coaxially within feeder tube 4, the other end 25 of said hollow stem 24 protruding from and creating a seal with said feeder tube rear-section. The cavity defined by hollow stem 24 communicates with the feeder tube fore-section 5 interior by way of a one-way valve 27 located at said lower end. The other end 25 of hollow stem 24 connects—by way of a third pipeline 26—with a source of pressurized, sterile gas represented schematically in FIG. 10 by block 21 and designed to urge said sterile gas into hollow stem 24 when operated. The obturator 28 of said one-way valve 27 which is normally retained in closed position against the valve seat by a spring 57, is forced open by pressure of said sterile gas urged into hollow stem 24 in the direction to open the valve for reasons more completely described hereafter.

Figure 2:
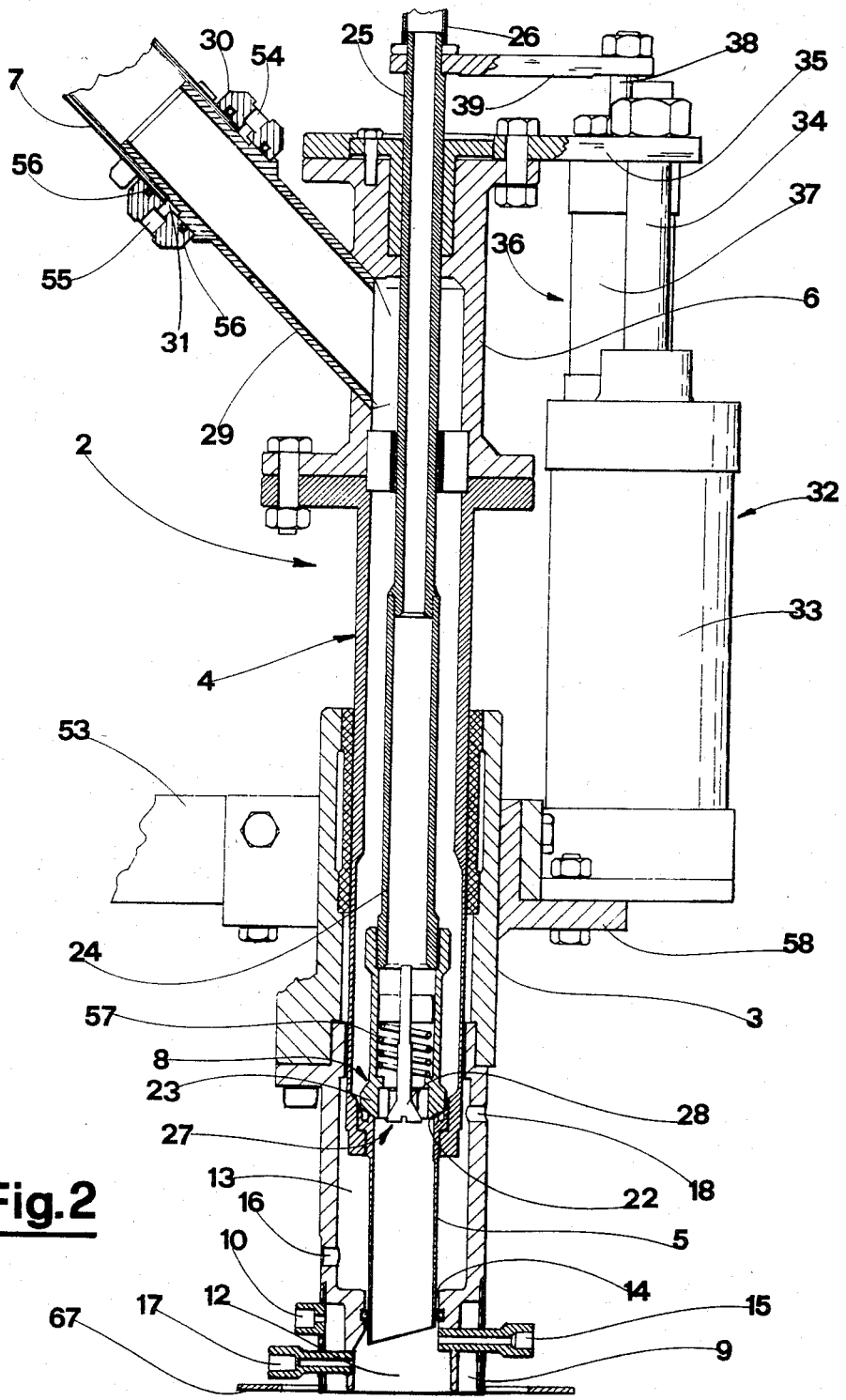
FIG. 2 shows the vertical elevation of a longitudinal cross-section of the apparatus workhead.
Figures 3, 4, 5:
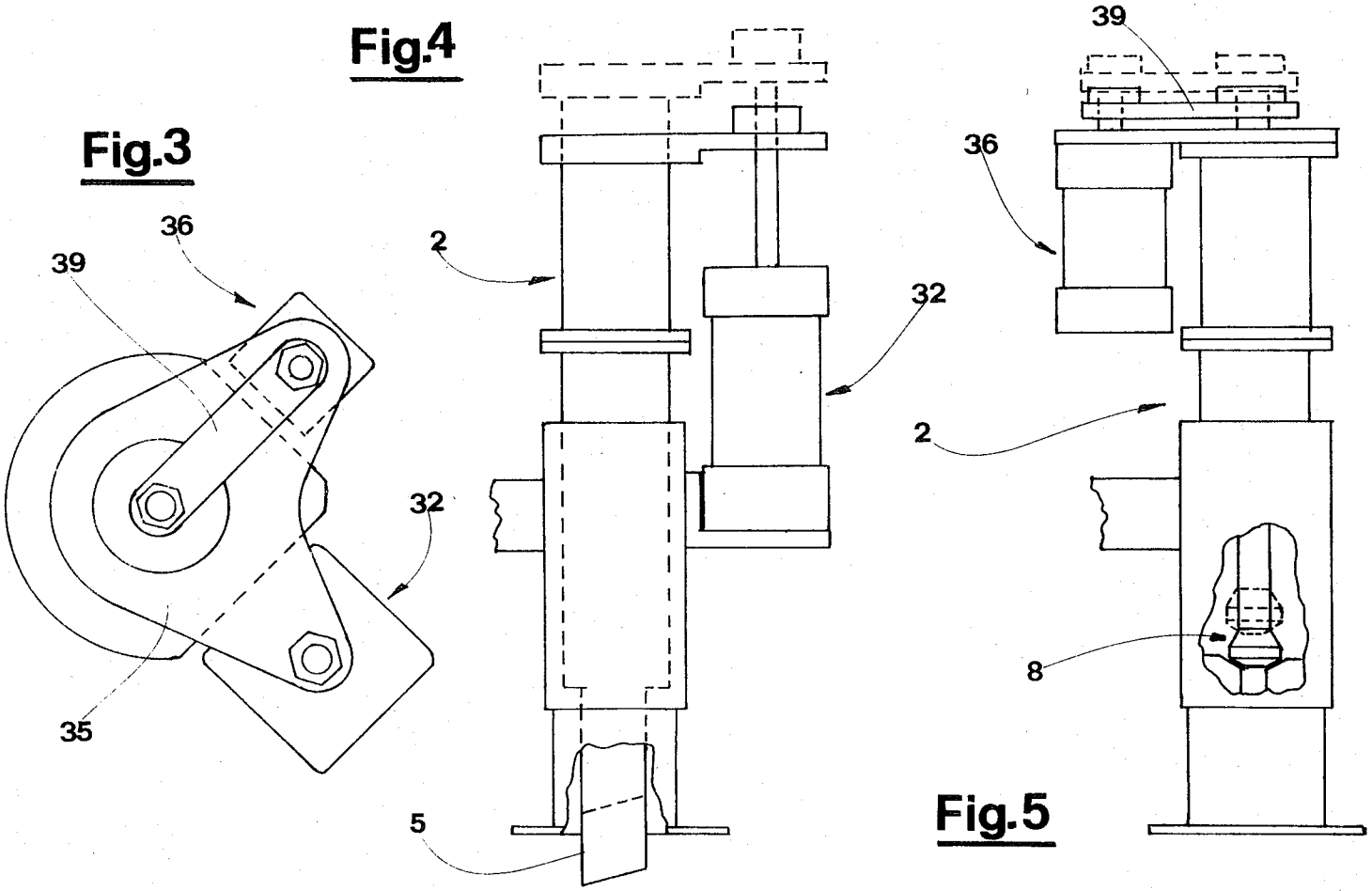
FIG. 3 shows a detail of the workhead's sliding components and the connection between and to their respective movers, viewed from above.
FIG. 4 is a schematic representation of the workhead with certain parts cut away, showing the feeder tube fore-section protruding forth from the workhead itself and demonstrating its syringe, or needle-like conformation.
FIG. 5 is a schematic representation of the workhead with certain parts cut away, showing the feeder tube with shut-off valve traced in the open position.

As shown in FIG. 2, a first mover is provided to produce the relative slide between guider element 3 and feeder tube 4. This mover comprises a first jack 32 disposed with axis parallel to that of the feeder tube, and having a cylinder 33 bolted to a flange 58 affixed to said guider element. The cylinder is thus rendered integral with the element itself. A piston rod 34 extending from the cylinder 33 is likewise made fast to a first mounting plate 35, which is in turn affixed to the rear extremity of feeder tube 4 so that the piston rod 34, mounting plate 35 and feeder tube 4 move together. A second mover is arranged to produce axial sliding of said hollow stem 24 with respect to feeder tube 4 thereby opening and closing shut-off valve 8. The second mover comprises a second jack 36, also disposed with axis parallel to that of said feeder tube, and having a cylinder 37 which is affixed to said first mounting plate 35 and a piston rod 38 which is affixed by a mounting plate 39 to the end 25 of hollow stem 24 protruding from feeder tube 4 so that the piston rod 38, plate 39 and stem 24 move together.

The arrangement of jacks 32 and 36 as described above furnishes independent back-and-forth movement both for feeder tube 4 with respect to guider element 3, and for stem 24 with respect to feeder tube 4. In fact, operation of the jack 32 produces movement both of feeder tube 4 and of the assemblage comprising jack 36 and hollow stem 24, whereas operation of the jack 36 produces only the back-and-forth sliding of hollow stem 24 itself—hence the opening and closing of shut-off valve 8.

An annular chamber 9, located at the lower extremity of guider element 3, opens outwardly from the said extremity and has a suction aperture 10 communicating through an appropriate duct with a device for producing suction. The duct and the suction device are represented schematically in FIG. 10 by a block 11 and a line 59. Thus the suction device 11 serves to extract air contained within annular chamber 9.

A further, forward chamber 12, likewise located at the extremity of guider element 3 and opening outwardly therefrom, is disposed coaxially with said guider element 3 and internally of annular chamber 9, though unconnected with the latter. The forward chamber 12 provides for the circulation—better described hereafter—both of pressurized sterile gas and of sterilizer fluid (chlorine water), for which purpose it is provided with an inlet aperture 15 and an outlet aperture 17.

Guider element 3 also incorporates a rear chamber 13 sealed from the exterior and disposed coaxially with said forward chamber 12 and connected thereto by way of a communicating hole 14, this furnishing the seat with and through which feeder tube fore-section 5, formed as a syringe, or needle, creats a seal and slides back and forth. This latter movement of feeder tube 4 with respect to guider element 3 is such that, whatever the position of foresection 5 with respect to guider element 3, the seal is maintained thereby between said forward and rear chambers.

Sterilizer fluid (chlorine water) is caused to circulate within rear chamber 13—as will be described at a later stage—to which end the chamber is provided with an inlet aperture 16 and an outlet aperture 18.

Figure 10:
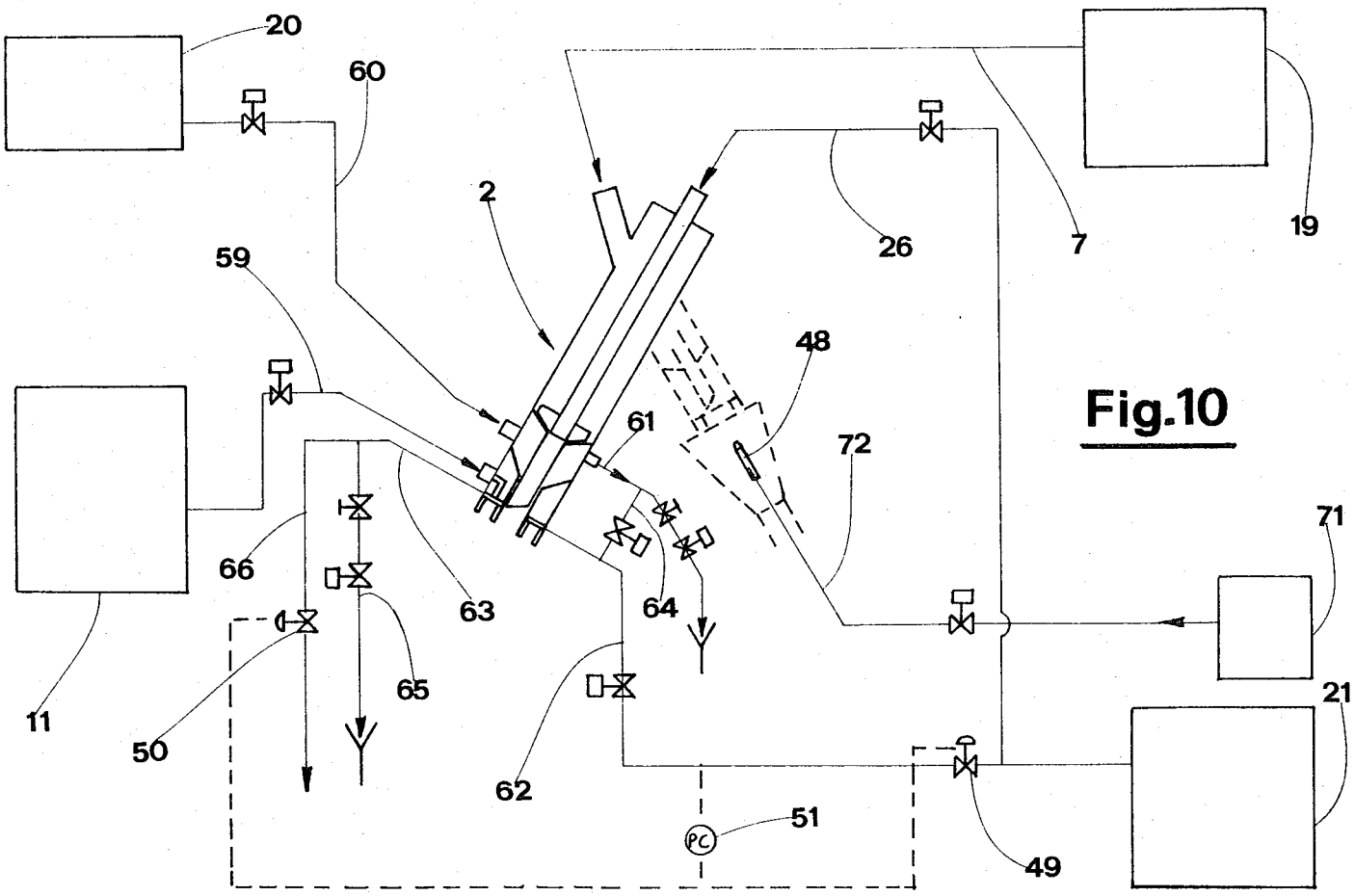
FIG. 10 is a schematic diagram showing conduits and related control and adjustment devices used in supplying both the foodstuff for batching, and sterilizer fluids to the workhead of the apparatus—plus a schematic representation of the suction apparatus.

The apparatus described herein comprises second feeder means designed for the introduction of sterile or sterilizing fluid into said forward and rear chambers, these said means and chambers connected by way of ducts represented schematically in FIG. 10. The rear chamber communicates with a source of chlorine water—denoted in FIG. 10 by block 20—by way of a duct 60 connected with inlet aperture 16; the outlet aperture 18 of said rear chamber being connected by way of duct 61 to the discharge.

The forward chamber communicates with a source of nitrogen—denoted by block 21—by way of a duct 62 connecting with inlet aperture 15, and the forward chamber outlet aperture 17 connects with the discharge by way of duct 63. Provision is made for a secondary duct 64, taken off from duct 61, said duct 64 serving to convey chlorine water discharged from rear chamber 13 into forward chamber 12. The chlorine water is eventally discharged via duct 63 out through a branch 65 taken off the latter, whilst nitrogen flowing in from duct 62 discharges similarly through duct 63, although makes its final exit by way of further branch 66. Needless to say, all such ducts and branches are furnished with appropriate shut-off valves.

For reasons which will be expounded further, pressure of the nitrogen in forward chamber 12 must be maintained at a pre-determined level. To this end means of regulating same are envisaged which comprise a first throttle-valve 49, capable of adjustment and positioned upstream of the forward chamber inlet aperture on duct 62. Provision is also made for a second, similarly-adjustable throttle-valve 50 positioned downstream of the forward chamber outlet aperture on duct 66. Both valves are adjusted in such a way as to open to a greater or lesser degree within a scope defined by a maximum and a minimum pressure limit. The minimum pressure level for one value corresponds to the maximum pressure level of the other, the resulting common pressure value constituting that pre-determined pressure level within said forward chamber 12. When the pressure level within said forward chamber rises above that pre-determined level, the first valve 49 closes and second valve 50 opens to the appropriate degree, whilst in the event that pressure in the chamber falls below that pre-determined level, first valve 49 opens accordingly, whilst second valve 50 closes. The degree to which valves 49 and 50 are caused to open depends upon the greater or lesser margin between the pre-determined pressure level and the pressure level actually prevailing within the forward chamber. The signal on which valves 49 and 50 rely in order to regulate is derived from a pressure-control device (PC) 51 in FIG. 10.

A third pipeline 26 is connected to nitrogen source 21 which—on operation of the latter—conveys sterile gas into hollow stem 24.

The invention described herein further comprises first feeder means—represented schematically in FIG. 10 by block 19—for despatching the foodstuff to be packaged into first pipeline 7, thence into feeder branch 29 and through to feeder tube 4.

The invention further comprises heat-sealing means for providing hermetical closure of the container once filled, said heat-sealing means shown only in part in the drawings, the visible component of same being a heat-plate 68 (in FIG. 8) which is applied to the container 1 following filling and held thus while container 1 is still engaged by the workhead 2. The operation is aided by the presence of an annular collar 67, disposed at the lower extremity of guider element 3 on the workhead 2, which has a greater diameter than the outer diameter of said guider element and has a lower surface substantially in the same plane as that occupied by the lower extremity of annular chamber 9. In the heat-sealing procedure the container 1 is compacted between heat-plate 68 and annular collar 67. It is also possible to dispense with the attachment of annular collar 67 to workhead 2 and achieve a heat-seal by placing the container between the heat-plate 68 and the abutting extremity of the outer workhead wall defining annular chamber 9.

The main upright 40 also serves as mounting for a waste device 45 connected at one end with a wastepipe 70, and having its other end shaped into a funnel 46. The waste device is disposed in such a way that the funnel extremity 46 axis is oriented in a direction bringing same approximately coaxial with workhead 2 when the latter assumes said third working posture C. A fifth mover is included consisting of a pneumatic unit denoted by 47 in FIG. 1, which when operated is designed to produce forward axial movement of funnel extremity 46 from a retracted position, in which the funnel extremity lies at a distance from workhead 2, into an advanced position, in which funnel extremity 46 encompasses the lower extremity of workhead 2, and vice-versa. This ensures that the funnel extremity 46 offers no hindrance to workhead 2 during the latter's rotation into third position C. On completion of the rotation of the workhead to position C, funnel extremity 46 is moved forwardly into advanced position where, as described, it enshields the workhead's lower extremity. Before workhead 2 is returned to either of its other positions A or B, funnel extremity 46 is brought back to the retracted position thus offering no hindrance to rotation of workhead 2. The funnel-shaped extremity 46 is equipped internally with a spray-nozzle 48, linked to a source of pressurized water. The spray-nozzle 48 is designed, when operated, to squirt water toward workhead 2. Block 71 of the schematic diagram of FIG. 10 denotes a water source connecting with nozzle 48 by way of a relative duct 72.

The apparatus thus described functions as follows: the containers 1 arrive, upheld in rigid support receptacles 52 carried along by conveyor 42, at the appropriate point beneath workhead 2. A photo-electric cell and mechanical stop-mechanism (not shown) ensure precise location of the container 1 with respect to the workhead 2.

Figure 6:
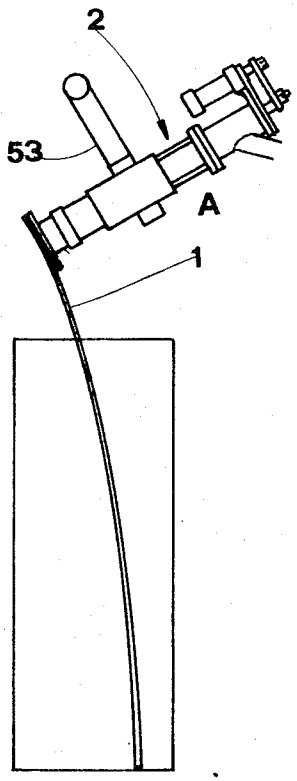

Workhead 2 lies initially in first working posture A shown in FIG. 6. Ideally—and for reasons about to be set forth—each container 1 should be provided with a small portion of its outer surface whose thickness is reduced with respect to the entire container wall. The workhead 2 is now connected to the container in the following manner. First, air is withdrawn from annular chamber 9 by means of suction produced upon operation of block 11. The operator of the apparatus engages the aforesaid reduced thickness portion of the container manually to the workhead itself in such a way that said portion encloses annular chamber 9. This creates a partial vacuum therein which serves to maintain container 1 in the desired contact with workhead 2. In this fashion a barrier is created between the environment and the said small portion of container surface 1, in particular that part thereof engaged with the workhead's forward chamber 12. Chlorine water from block 20 circulates within rear chamber 13 of the workhead at a temperature of approx. 70° C. Thus far, the lower extremity of feeder tube foresection 5 remains within forward chamber 12.

Chamber 12, along with fore-section extremity 5 and the small portion of container surface 1, are nonsterile by dint of their having been in contact with the environment. Sterilization of said small portion and all workhead parts in immediate contact therewith—in short, forward chamber 12 and fore-section extremity 5—is now effected. This is accomplished by opening the valve controlling duct branch 64 and closing the valve governing discharge on duct 61. Chlorine water circulating in rear chamber 13 then passes into forward chamber 12 duly bathing all surfaces exposed to that chamber. A pre-determined period of time (about 60 seconds) is allowed to lapse before re-shutting the valve on duct 64, and re-opening that on duct 61.

The parts thus sterilized are now washed. For this purpose, the valve in duct 62 is opened, letting nitrogen into forward chamber 12 in order to ensure expulsion of any residual chlorine water from the forward chamber 12 to preclude the possibility of its being drawn subsequently into the container 1. The nitrogen pressure level within forward chamber 12 is regulated by throttle valves 49 & 50 as previously described.

Figure 7:
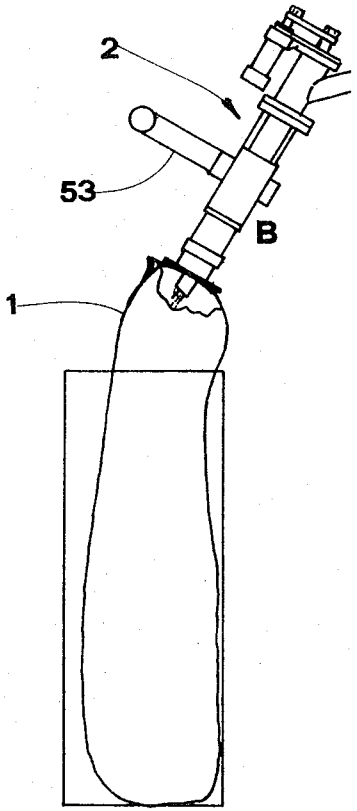

The workhead, with the container 1 still attached to it, is now brought into second working posture B (FIG. 7), in which perforation of the container, more particularly, of that small portion communicating with forward chamber 12, may be carried out. To this end the rod driven by jack 32 is lowered, thereby lowering feeder tube 4 and in particular its fore-section 5 which—as stated previously—has a syringe, or needle-like conformation. This lowering movement is stopped immediately upon perforation of container 1 by fore-section 5. This is done in order to obviate accidental puncture of the container's rear wall, which at this stage is in close proximity to that small portion of container 1 whereon workhead 2 has been attached, it being remembered that the container is supplied in a flat, non-rigid format.

Perforation being thus achieved, nitrogen is introduced into container 1 through the resultant hole, by which the container interior now communicates with workhead forward chamber 12, into which nitrogen is currently flowing, as already described. The flow of nitrogen inflates the container 1 after which feeder tube 4 may be advanced further into the container itself without fear of the wall thereof being punctured.

Once feeder tube 4 is introduced fully into the container, the foodstuff may be introduced therein by operating the jack 36 the hollow stem 24 is raised, thereby opening shut-off valve 8 and enabling the foodstuff despatched from block 19 to flow down into container 1 itself. Introduction of the desired quantity being completed, shut-off valve 8 is closed by reverse operation of jack 36 and reverse operation of jack 32 causes the upward withdrawal of feeder tube 4. All stages thus described may be controlled manually or automatically, for instance by the use of timers. Taking foodstuff introduction as an example, termination of the foodstuff's passage into container 1 could be commanded automatically by a weight-reading device which—once the weight in the container reaches the desired limit—will send the appropriate signal required for working of jack 36 which then causes closure of valve 8.

Throughout the filling operation, nitrogen formerly introduced into container 1 exits therefrom simultaneously with entry of the foodstuff, returning into forward chamber 12. During this operation the pressure level of said nitrogen is maintained constant within chamber 12 by means of throttle-valves 49 and 50. For easier exit of nitrogen from within the container, the feeder tube's fore-section 5 may be fluted along the outer surface, or even provided with suitable perforation.

Figure 8:
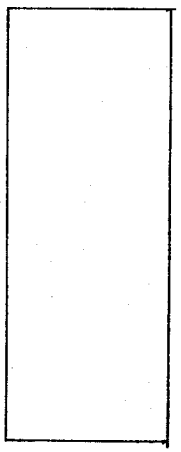
Figure 8:
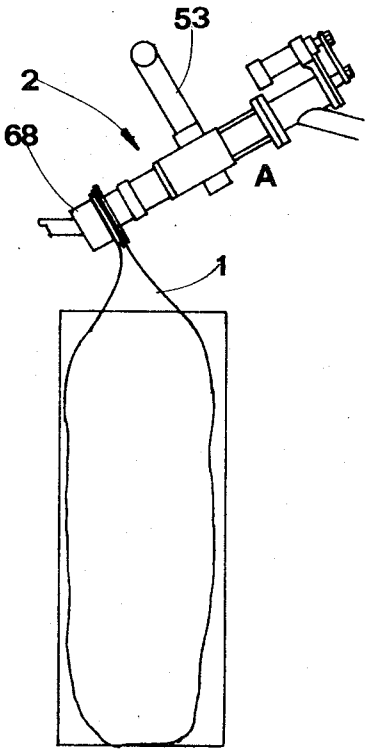

Workhead 2 is now returned to first working posture A (see FIG. 8).

Hermetical closure of the container is effected at this juncture, by means of heat-sealing. To accomplish this, heat-plate 68 is held against workhead 2, being applied—more exactly—to annular collar 67. Thus that part of container 1 compressed between plate 68 and collar 67 is heat-sealed. In this fashion, the punctured area of container 1 becomes isolated from the rest of same thus preventing intrusion therein of non-sterile air.

While the container 1 is being compacted between plate 68 and collar 67, any excess nitrogen present in the container is expelled.

Once the flow of nitrogen into forward chamber 12 is stopped, annular chamber 9 is relieved of its partial vacuum by working the valve governing suction conduit 59, thus causing container 1—now hermetically sealed—to separate from workhead 2.

Figure 9:
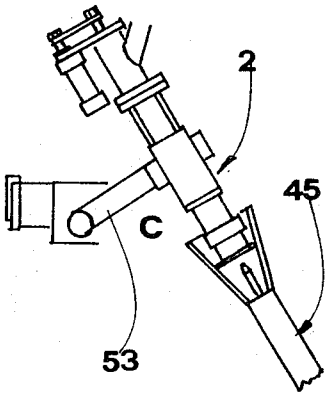
FIGS. 6, 7, 8 & 9 are schematic views showing the various working postures adopted by the head used in the apparatus to which the invention refers.

Workhead 2 is now brought into third working posture C (FIG. 9). By working pneumatic mover 47 the waste device 45 moves into advanced position thus enabling funnelshaped extremity 46 to encompass the lower workhead extremity as described previously.

By operating the valve controlling third pipeline 26 pressurized nitrogen is caused to enter hollow stem 24 with the result that one-way valve 27 is urged open, occasioning expulsion of such foodstuff as remains lodged within fore-section 5 of the feeder tube. It should be observed that, if desired, said valve 27 may be opened upon termination of the filling operation—prior to removal of feeder tube 4 from the container—in order to inject any remnant of foodstuff within fore-section 5 down into the container 1. This would not be necessary, however, with low-viscosity foodstuffs which do not adhere to the feeder tube foresection 5 interior.

The workhead may now be cleaned. For this purpose, the valve controlling duct 72 is opened, supplying pressurized hot water to spray-nozzle 48, which squirts the same towards forward chamber 12 thus bringing about a thorough cleansing of the chamber itself and of the feeder tube foresection 5. The cleaning water is then gathered by funnel-extremity 46 and discharged—along with any dislodged foodstuff—through waste-pipe 70. Thereafter, the waste-device is withdrawn to its retracted position by operating the related pneumatic mover 47.

The workhead now returns to first working posture, or position A, in readiness for recommencement of the cycle thus described. Should the conveyor 42 accommodate two or more parallelly-disposed containers 1 (as depicted in FIG. 1), the workhead may be positioned with respect to the next container in succession by working said third mover 43 thus producing the necessary movement of the head itself along traverse 41. Once all such parallelly-disposed containers are full—following completion of the above-described cycle(s)—the rank of containers thus filled may be moved along by operation of conveyor 42, the latter bringing forward and positioning successive rank into and at the correct alignment with respect to workhead 2.

Numerous modifications of a practical or applied nature may be made to the invention without departing from the scope of the invention concept as claimed below.

What is claimed is:

1. A process for aseptic filling of pre-sterilized, non-rigid containers comprising attaching a workhead to the outer surface of a small portion of the container, sterilizing the outer surface of the small portion and the attached parts of the workhead, piercing the small portion of the container, introducing sterile gas into the container through the pierced portion, introducing a feeder tube through the pierced portion, introducing foodstuff into the container through the feeder tube while permitting sterile gas to be expelled from the container through the pierced portion, terminating the flow of foodstuff into the container, withdrawing the feeder tube, hermetically sealing the container, separating the workhead from the container, and cleaning the workhead.

2. A process according to claim 1 wherein attachment of the workhead to the container is achieved by means of suction.

3. A process according to claim 1 wherein the sterilizing is effected utilizing chlorine water heated to approximately 70° C.

4. A process according to claim 1 including the step of washing the sterilized container portion and attached workhead parts before piercing the container portion.

5. A process according to claim 4 wherein the washing is effected utilizing sterile gas.

6. Apparatus for aseptic filling of pre-sterilized non-rigid containers comprising a workhead including a guider element, a feeder tube coaxially-disposed in the guider element capable of axial movement therein, the forward end of the feeder tube being formed to pierce a container, a first pipe connected to the feeder tube for injection of foodstuff into the feeder tube, a shut-off valve in the feeder tube disposed between the forward end thereof and the first pipe, the guider element having an annular chamber opening toward the forward end of the workhead, suction means connected to the annular chamber, the guider element also having a forward chamber opening toward the forward end of the workhead and disposed within the annular chamber and internally isolated therefrom and a rear chamber isolated from the exterior of the workhead and communicating with the forward chamber through an aperture therebetween, sealing means between the guider element and the forward end of the feeder tube forming a seal between the forward and rear chambers while permitting sliding motion of the forward end of the feeder tube therewith, each of the forward and rear chambers being formed with inlet and outlet apertures permitting entry into and exit from either chamber of sterile or sterilizing fluid, a first mover connected to the feeder element and adapted to move it back and forth within the guider element, first feeder means for introducing foodstuff into the first pipe, second feeder means for introducing sterile or sterilizer fluid to the forward and rear chambers, regulator means for regulating the flow of fluid through the forward chamber so as to maintain a pre-determined pressure level therein, and means for heat-sealing the container hermetically following filling thereof.

7. Apparatus according to claim 6 including a hollow stem supported coaxially with the forward end of the feeder tube and wherein the shut-off valve has a seat located on the inner surface of the feeder tube and the obturator of the shut-off valve is located upon the outer surface of the forward end of the hollow stem, the other end of the hollow stem being connected to a source of sterile gas which, when pressurized, is forced into the hollow stem under pressure, the hollow stem having a one-way valve at its forward end which opens into the forward end of the feeder tube, the obturator of the one-way valve being opened by pressure of the sterile gas within the hollow stem, and a second mover for producing axial movement of the hollow stem to open and close the shut-off valve.

8. Apparatus according to claim 6 wherein the feeder tube has a branch extending laterally from the rear section of the feeder tube, the branch being axially inclined with respect to the rear section and being internally connected therewith, the first pipe being connected with the end of the branch.

9. Apparatus according to claim 8 wherein the connection between the branch and the first pipe comprises a union having an annular groove located in close proximity to the mating surfaces of the branch and the first pipe through which pressurized sterile fluid circulates, and sealing means on opposite sides of the annular groove.

10. Apparatus according to claim 6 wherein the first mover comprises a jack disposed with its axis parallel to that of the feeder tube and having a cylinder affixed to the guider element and a piston rod affixed to a mounting plate which in turn is affixed to the rear extremity of the feeder tube.

11. Apparatus according to claim 7 wherein the second mover comprises a jack disposed with its axis parallel to that of the feeder tube and having a cylinder affixed to a first mounting plate which in turn is affixed to the rear extremity of the feeding tube and a piston rod affixed to a second mounting plate which is affixed to said other end of the hollow stem.

12. Apparatus according to claim 6 including support means comprising an upright member having a horizontal traverse and a conveyor for conveying containers beneath the traverse, the workhead being carried by the traverse, and a third mover for moving the workhead along the traverse.

13. Apparatus according to claim 12 including a fourth mover movable with the workhead along the traverse and adapted to orient the workhead to a plurality of angularly distinct working postures.

14. Apparatus according to claim 13 wherein the fourth mover causes the workhead to adopt first, second and third working postures, each angularly distinct from the others, the axis of the workhead being disposed at about 60° to the vertical in the first working posture, at about 30° to the vertical in the second working posture, and at about 30° to the vertical and on the opposite side of the vertical from first and second postures in the third working posture.

15. Apparatus according to claim 14 including a waste device attached to the upright member and having a funnel-shaped end, the waste device being connected to a waste pipe, the axis of the funnel-shaped end being disposed so as to lie approximately coaxial with the workhead when the workhead is in the third working posture, a fifth mover for moving the funnel-shaped end between a retracted position in which the funnel shaped end is spaced from the workhead and an advanced position in which the funnel-shaped end encloses the forward end of the workhead.

16. Apparatus according to claim 15 including a spray-nozzle disposed within the funnel-shaped end, the spray nozzle being connected to a source of pressurized water and adapted, when operated, to direct water toward the workhead.

17. Apparatus according to claim 6 wherein the regulator means comprises a first adjustable throttle-valve positioned upstream of the forward chamber inlet aperture and a second adjustable throttle-valve positioned downstream from the forward chamber outlet aperture and a pressurecontrol device arranged to close the second valve and open the first valve when the pressure in the forward chamber falls below a predetermined level and to close the first valve and open the second valve when the pressure in the forward chamber rises above the predetermined level.

18. Apparatus according to claim 6 wherein the workhead comprises an annular collar located at the forward extremity of the guider element, the collar having greater diameter than the outer diameter of said guider element and having a forward surface disposed substantially within the same plane as the forward extremity of the annular chamber.

19. Apparatus according to claim 6 including a weighing device to hold a container being filled and adapted to supply a shut-off signal to close the shut-off valve when a predetermined weight of foodstuff has been introduced into a container.

* * * * *